US011840086B2

(12) United States Patent
Narumi

(10) Patent No.: US 11,840,086 B2
(45) Date of Patent: Dec. 12, 2023

(54) RECORDING APPARATUS AND METHOD FOR CONTROLLING THE SAME

(71) Applicant: CANON KABUSHIKI KAISHA, Tokyo (JP)

(72) Inventor: Kazuki Narumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 17/511,424

(22) Filed: Oct. 26, 2021

(65) Prior Publication Data

US 2022/0134757 A1 May 5, 2022

(30) Foreign Application Priority Data

Oct. 30, 2020 (JP) ..... 2020-181988

(51) Int. Cl.
*B41J 2/165* (2006.01)

(52) U.S. Cl.
CPC .. *B41J 2/16505* (2013.01); *B41J 2002/16594* (2013.01)

(58) Field of Classification Search
CPC ..... B41J 2/16505; B41J 2/16532
See application file for complete search history.

(56) References Cited

U.S. PATENT DOCUMENTS 6,179,404 B1 * 1/2001 Kawarama ..... B41J 2/16508 347/31
2007/0247483 A1 10/2007 Miyazawa
2019/0240986 A1 8/2019 Nakamura et al.

FOREIGN PATENT DOCUMENTS

JP 3952528 B2 * 8/2007
JP 2011156674 A 8/2011
JP 2018086741 A 6/2018
JP 2019171787 A * 10/2019
JP 2019171787 A 10/2019

* cited by examiner

*Primary Examiner* — Sharon Polk
(74) *Attorney, Agent, or Firm* — Canon U.S.A., Inc. IP Division

(57) ABSTRACT

A recording apparatus includes a recording head having discharge ports for discharging a liquid, a cap configured to cap the discharge ports, a switching unit configured to switch between a communication state where an inside of the cap communicates with the atmosphere and a non-communication state where the inside of the cap does not communicate with the atmosphere, and a depressurization unit configured to depressurize the inside of the cap. After driving of the depressurization unit is started while the cap is at a capping position for capping the discharge ports and is in the non-communication state, the switching unit switches the cap to the communication state and then the driving of the depressurization unit is stopped. Idle suction is performed by driving the depressurization unit while the cap is at the capping position and is in the communication state.

10 Claims, 13 Drawing Sheets

FIG.9

| | SUCTION TIME | SUCTION AMOUNT | OVERSUCTION AMOUNT |
|---|---|---|---|
| FIRST EXEMPLARY EMBODIMENT | 2.2 sec | 230 mg | 0 mg |
| FIRST COMPARATIVE EXAMPLE | 2.0 sec | 260 mg | 30 mg |
| SECOND COMPARATIVE EXAMPLE | 2.0 sec | 230 mg | — |

ONES PLACE IS ROUNDED OFF

RECORDING APPARATUS AND METHOD FOR CONTROLLING THE SAME

BACKGROUND

Field of the Disclosure

The present disclosure relates to a recording apparatus that records an image and a method for controlling the recording apparatus.

Description of the Related Art

A conventional recording apparatus for recording an image by discharging a liquid from a recording head performs maintenance processing for the recording head as appropriate. The maintenance processing includes a suction operation for forcibly sucking a liquid from discharge ports of the recording head to remove foam and impurities from the head, a wiping operation for wiping out droplets on a discharge port surface where the discharge ports are arranged, and a preliminary discharge operation for adjusting a discharge operation prior to recording.

In the suction operation of the maintenance processing, a cap for capping the discharge port surface, a tube connected to the cap, and a pump connected to the tube are generally used. An air communication valve may also be used to selectively enable or disable communication between an inside of the cap and the atmosphere.

Japanese Patent Application Laid-Open No. 2011-156674 discusses a configuration including an air communication tube for communicating the inside of the cap with the atmosphere, and a waste ink tank for storing a liquid that flows into the air communication tube. The liquid that flows into the air communication tube can be discharged to the waste ink tank by sending air into the cap while reversely driving the suction pump.

However, with the configuration discussed in Japanese Patent Application Laid-Open No. 2011-156674, the waste ink tank connected to the air communication tube needs to be provided separately, which may result in a complicated apparatus configuration.

SUMMARY

Embodiments of the present disclosure are directed to suppressing a liquid from remaining in a tube connected to a cap, by using a simple configuration.

According to embodiments of the present disclosure, a recording apparatus includes a recording head having discharge ports for discharging a liquid, a cap configured to cap the discharge ports, a switching unit configured to switch between a communication state where an inside of the cap communicates with the atmosphere and a non-communication state where the inside of the cap does not communicate with the atmosphere, and a depressurization unit configured to depressurize the inside of the cap. After driving of the depressurization unit is started while the cap is at a capping position for capping the discharge ports and is in the non-communication state, the switching unit switches the cap to the communication state and then the driving of the depressurization unit is stopped. Idle suction is performed by driving the depressurization unit while the cap is at the capping position and is in the communication state.

Further features of the present disclosure will become apparent from the following description of exemplary embodiments with reference to the attached drawings.

BRIEF DESCRIPTION OF THE DRAWINGS

FIG. 9 is a table illustrating the effect of the oversuction countermeasure sequence according to the first exemplary embodiment.

DESCRIPTION OF THE EMBODIMENTS

Exemplary embodiments of the present disclosure will be described below with reference to the accompanying drawings. The exemplary embodiments described below do not limit the present disclosure. Not all combinations of features described in the exemplary embodiments are indispensable to the solutions for the present disclosure. Relative arrangements and shapes of components described in the exemplary embodiments are merely examples and do not intend to limit the scope of the present disclosure thereto.

Figure 1A:
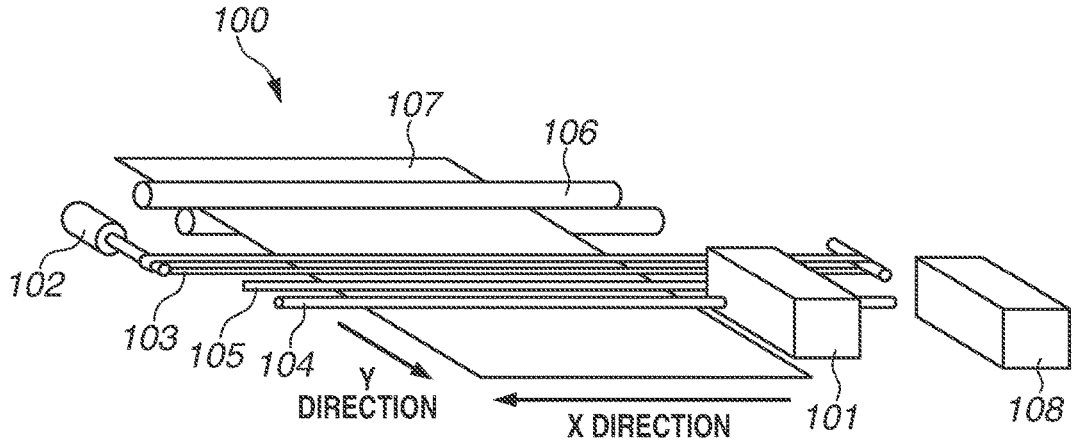
FIG. 1A is a perspective view illustrating an internal configuration of an inkjet recording apparatus according to a first exemplary embodiment.

FIG. 1A is a perspective view illustrating an internal configuration of an inkjet recording apparatus (hereinafter referred to as a recording apparatus) 100 according to a first exemplary embodiment of the present disclosure. The recording apparatus 100 includes a recording head 109 (see FIG. 2) having discharge ports for discharging liquid ink, and a movable carriage 101 on which the recording head 109 is mounted. The carriage 101 reciprocates in an X direction illustrated in FIG. 1A while being guided and supported by a guide shaft 104, with a movement of a timing belt 103 driven by a carriage motor 102 serving as a drive source. A flexible cable 105 electrically connects a main body substrate of the recording apparatus 100 and the recording head 109 while following the movement of the carriage 101. A recovery device 108 is provided at one end of the moving range of the carriage 101. The recovery device 108 performs recovery processing for appropriately maintaining a discharge function of the recording head 109

A conveyance roller pair 106 pinches a recording medium 107, and rotates to convey the recording medium 107 in a predetermined direction (a Y direction) intersecting with the X direction. In the present exemplary embodiment, the X direction and the Y direction perpendicularly intersect with each other. While moving together with the carriage 101 in the X direction, the recording head 109 discharges ink droplets based on recording data to record an image having a predetermined length (corresponding to one band) on the recording medium 107 (which is referred to as a recording operation). When the image corresponding to one band has been recorded, the recording medium 107 is conveyed by a predetermined amount by the rotation of the conveyance roller pair 106 (which is referred to as an intermittent conveyance operation). Images are recorded on the entire recording medium 107 by using a serial recording method that repeats the recording operation corresponding to one band and the intermittent conveyance operation.

Figure 1B:
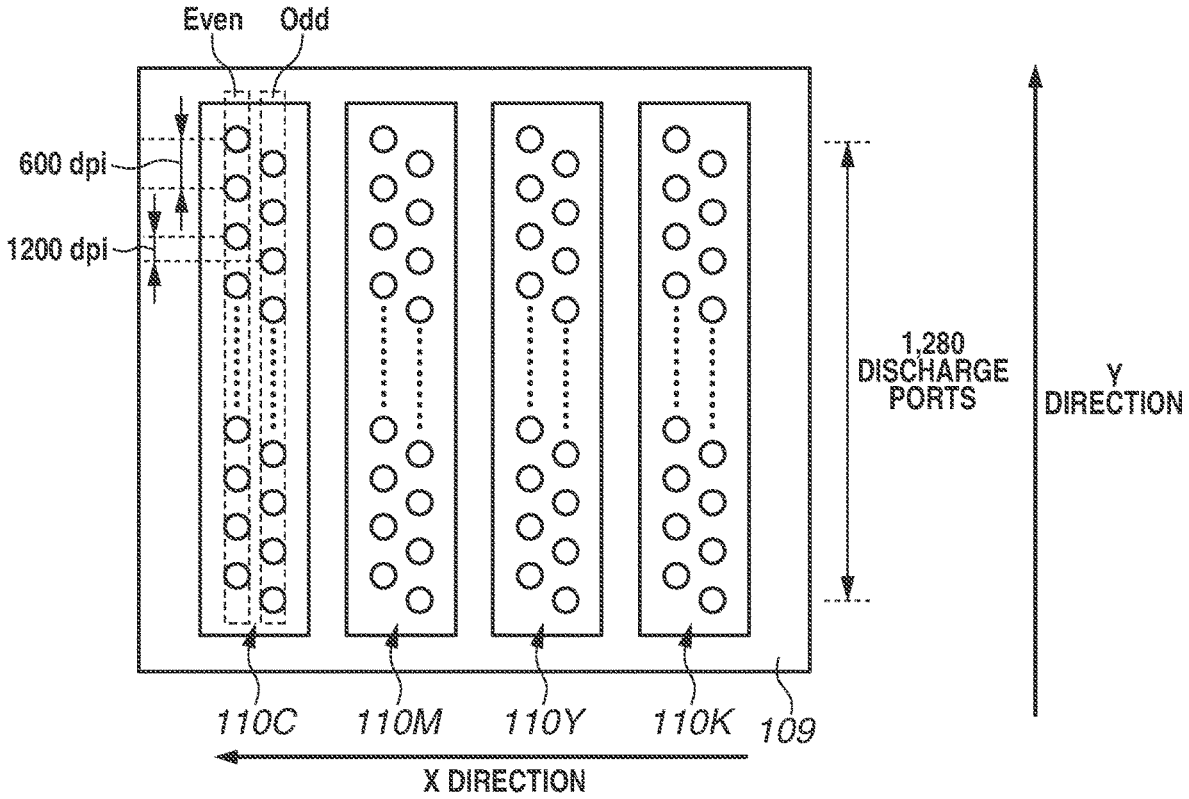
FIG. 1B is a schematic view illustrating a discharge port surface side of a recording head according to the first exemplary embodiment.

FIG. 1B schematically illustrates a discharge port surface side of the recording head 109 according to the present exemplary embodiment, on which the discharge ports for discharging ink are arranged. The recording head 109 includes discharge port arrays 110 (110K, 110C, 110M, and 110Y) for four different ink colors, where 1,280 discharge ports are arranged in the Y direction based on a density of 1,200 dots per inch (dpi). In the present exemplary embodiment, the discharge port array 110K for discharging black ink, the discharge port array 110C for discharging cyan ink, the discharge port array 110M for discharging magenta ink, and the discharge port array 110Y for discharging yellow ink are arranged in the X direction of the recording head 109.

Each of the discharge port arrays 110K, 110C, 110M, and 110Y includes two rows of discharge port arrays each having discharge ports arranged based on a density of 600 dpi. The two rows are staggered by a shift amount of 1/1,200 inches. With the two rows (also referred to as the Even row and the Odd row) considered as one discharge port array, dots with a density of 1,200 dpi can be formed on the recording medium 107. The amount of ink droplets to be discharged from each of the discharge ports (the discharge amount) is about 4.5 pl. However, to achieve a high density of the black ink, the discharge amount of the black ink may be set to be larger than those of the other inks.

The recording head 109 according to the present exemplary embodiment is an inkjet head that discharges ink by using thermal energy, and includes an electrothermal transducer for generating thermal energy inside the discharge ports.

The ink discharge method is not limited to the method using thermal energy, and other methods such as a method using a piezoelectric element may be used.

Discharging ink droplets while scanning the recording head 109 in the X direction enables formation of dots with a recording density of 2,400 dpi in the X direction and a recording density of 1,200 dpi in the Y direction. The recording head 109 for discharging the ink of the four colors (black ink, cyan ink, magenta ink, and yellow ink) may be independently formed for each color or integrally formed. In addition to the ink of the four colors, light cyan ink and light magenta ink may be added to improve granularity, or red ink, green ink, and blue ink may be added to improve color development. In other words, the colors of the ink discharged from the recording head 109 are not limited to the four colors according to the present exemplary embodiment.

The recording head 109 and an ink tank 213 (see FIG. 2) are attachable to and detachable from the carriage 101 according to the present exemplary embodiment. In the present exemplary embodiment, the recording head 109 and the ink tank 213 are integrally mounted on the carriage 101.

The remaining ink amount of the ink tank 213 is detected based on a value of a dot counter that counts the amount of ink discharged from the discharge port arrays 110 of the recording head 109. The dot counter can be implemented by a control unit (described below). The ink discharged from the discharge port arrays 110 includes the ink discharged from the discharge port arrays 110 for the recording operation, and the ink sucked and discharged from the discharge port arrays 110 for the recovery processing.

The dot counter counts the value obtained by multiplying the number of discharges by the volume per ink droplet, and counts the suction and discharge amount (hereinafter referred to as the suction amount). A memory for storing the remaining ink amount of the ink tank 213 is provided to store the dot count value, which facilitates management of the remaining ink amount in the ink tank 213. The control unit can also access this memory to detect whether the ink tank 213 is attached to the recording apparatus 100.

The dot count value managed by the dot counter indicates the amount of ink discharged from the recording head 109. The larger value indicates a state where a larger amount of ink has been discharged. For example, when the control unit notifies the user of the remaining ink amount of the ink tank 213 by using the dot count value stored in the memory, the control unit performs the notification based on a value obtained by subtracting the dot count value from the full capacity of the ink tank 213.

Figure 2:
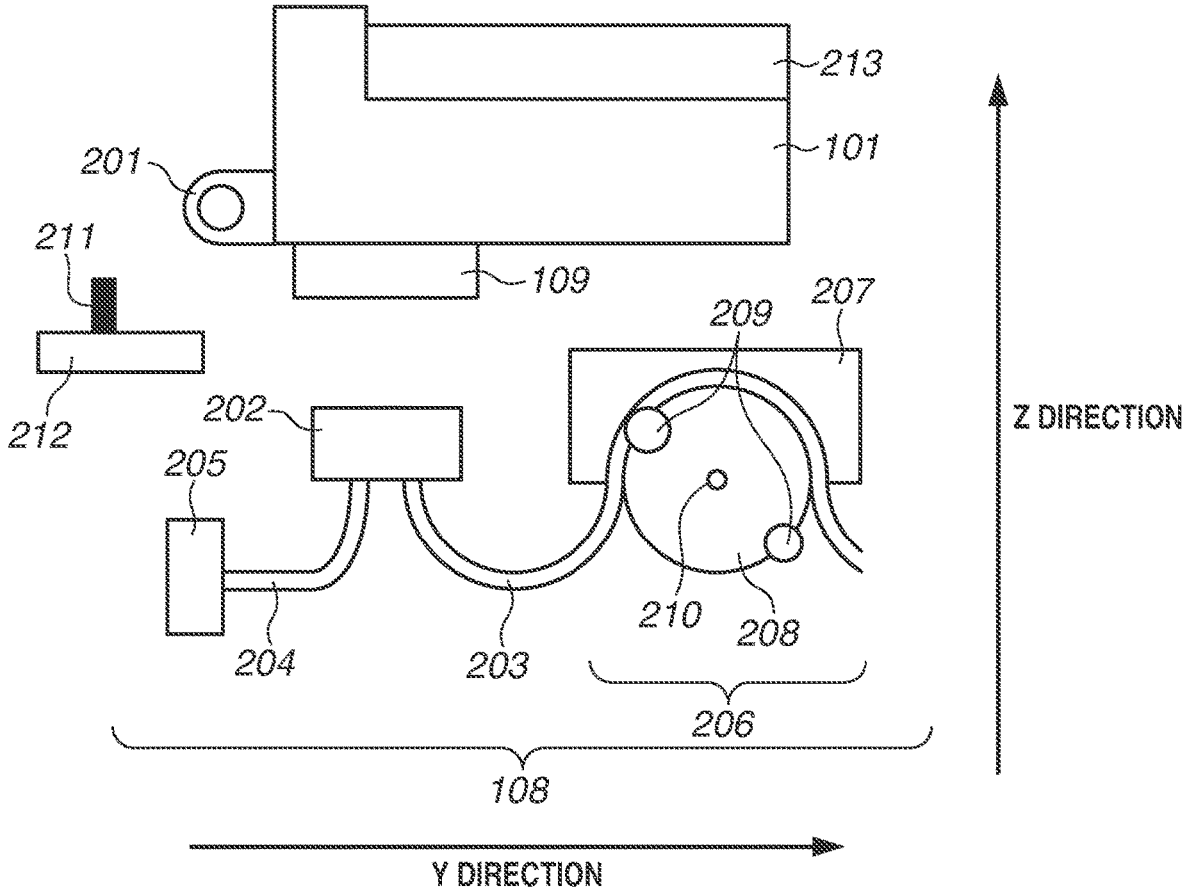
FIG. 2 is a schematic view illustrating a detailed configuration of a recovery device according to the first exemplary embodiment.

FIG. 2 schematically illustrates a detailed configuration of the recovery device 108. Referring to FIG. 2, the carriage 101 includes a bearing member 201 for engaging with the guide shaft 104. The recording head 109 is held by the carriage 101 in a state of being fluidly connected with the ink tank 213.

The recovery device 108 includes a cap 202 for capping the discharge port surface of the recording head 109, a suction tube 203 connected with the cap 202, and a suction pump 206 for depressurizing an inside of the cap 202 via the suction tube 203. The cap 202 is configured to be moved in a Z direction (a gravity direction) by a drive mechanism (not illustrated). In a state where the carriage 101 (the recording head 109) is located at a home position facing the recovery device 108, the cap 202 is moved up to cap the discharge port surface, and is moved down to be separated from the discharge port surface. In FIG. 2, the cap 202 is located at a separated position where the cap 202 is separated from the discharge port surface.

The suction tube 203, made of rubber or resin, has flexibility and forms a discharge path for discharging the ink sucked from the cap 202. In the present exemplary embodiment, a tube pump is used as the suction pump 206 that is a depressurization unit. While in the present exemplary embodiment, a tube pump is used as the suction pump 206, other types of suction pump may be used as the suction pump 206. The ink sucked by the suction pump 206 is stored in a waste ink absorber (not illustrated).

The suction pump 206 includes a plastic pump base 207 that regulates the suction tube 203 from the outside, and a roller holder 208 incorporating rotatable rollers 209 that press the suction tube 203. A semicircular tube guide surface is formed by the pump base 207 and the roller holder 208. The roller holder 208 is provided with the two rollers 209 that are held to be rotatable about a rotation axis 210. When the rollers 209 move while squeezing the suction tube 203, a negative pressure is generated inside the cap 202.

The recovery device 108 also includes an air communication tube 204 that communicates the inside of the cap 202 with the atmosphere, and an air communication valve 205 that opens and closes the air communication tube 204.

Similarly to the suction tube 203, the air communication tube 204 is made of rubber or resin and has flexibility. The air communication valve 205 is a switching unit for switching between an open state (a communication state) where the inside of the cap 202 communicates with the atmosphere and a closed state (a non-communication state) where the inside of the cap 202 does not communicate with the atmosphere, via a cam mechanism (not illustrated).

The recovery device 108 further includes a wiper 211 that wipes the discharge port surface by moving while being in contact with the discharge port surface, and a wiper holder 212 that holds the wiper 211. When the wiper holder 212 slides in the Y direction in a state where the cap 202 is moved down and separated from the discharge port surface, the wiper 211 wipes ink droplets and paper dust remaining on the discharge port surface.

Figure 3:
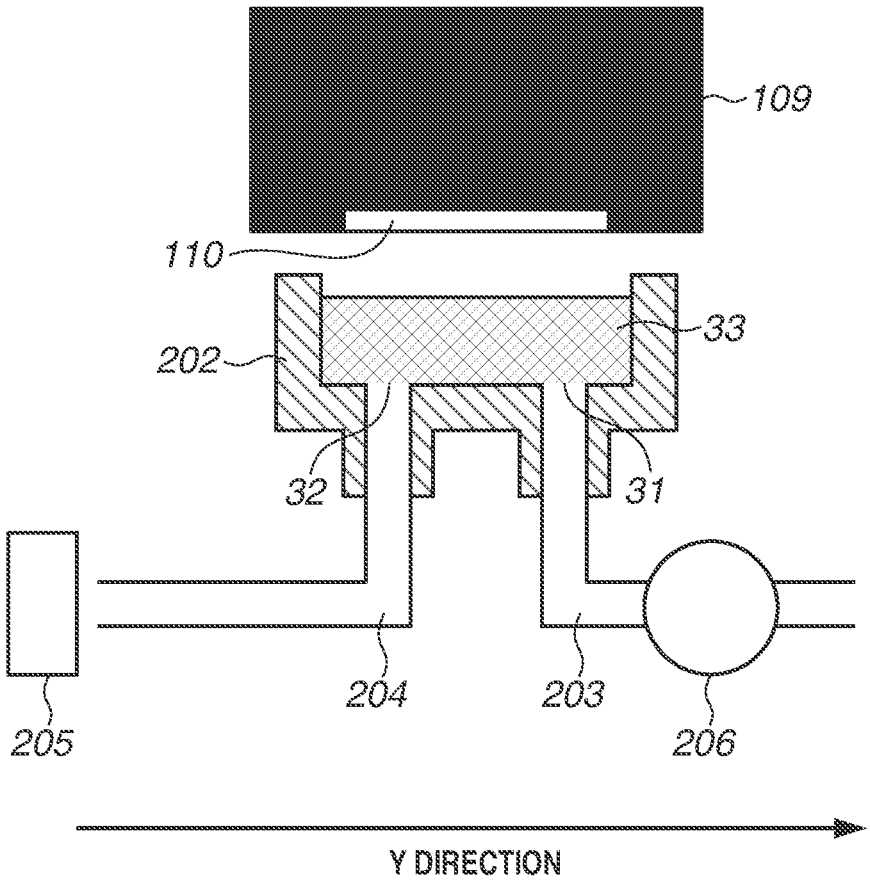
FIG. 3 is an enlarged cross-sectional view illustrating a cap configuration according to the first exemplary embodiment.

FIG. 3 is an enlarged cross-sectional view of the cap 202 and an area around the cap 202, which illustrates a detailed configuration of the cap 202. The cap 202 illustrated in FIG. 3 is located at the separated position. A suction port 31 connected with the suction tube 203, and an air communication port 32 connected with the air communication tube 204 are formed in the cap 202. The cap 202 also includes a porous absorber 33 capable of absorbing ink.

The suction port 31 and the air communication port 32 are provided in the cap 202 near the center in the X direction so that ink is sucked as uniformly as possible from the plurality of discharge port arrays 110. The configuration is however not limited thereto. If the suction intensity is to be changed depending on the ink type, a configuration in which the suction port 31 is provided near a position facing the discharge port array for which the suction intensity is to be increased may be employed.

While in the present exemplary embodiment, the cap 202 is configured to collectively suck the plurality of discharge port arrays 110, the cap 202 may be separately prepared for each of the discharge port arrays 110.

<Configuration Example of Image Processing System>

Figure 4:
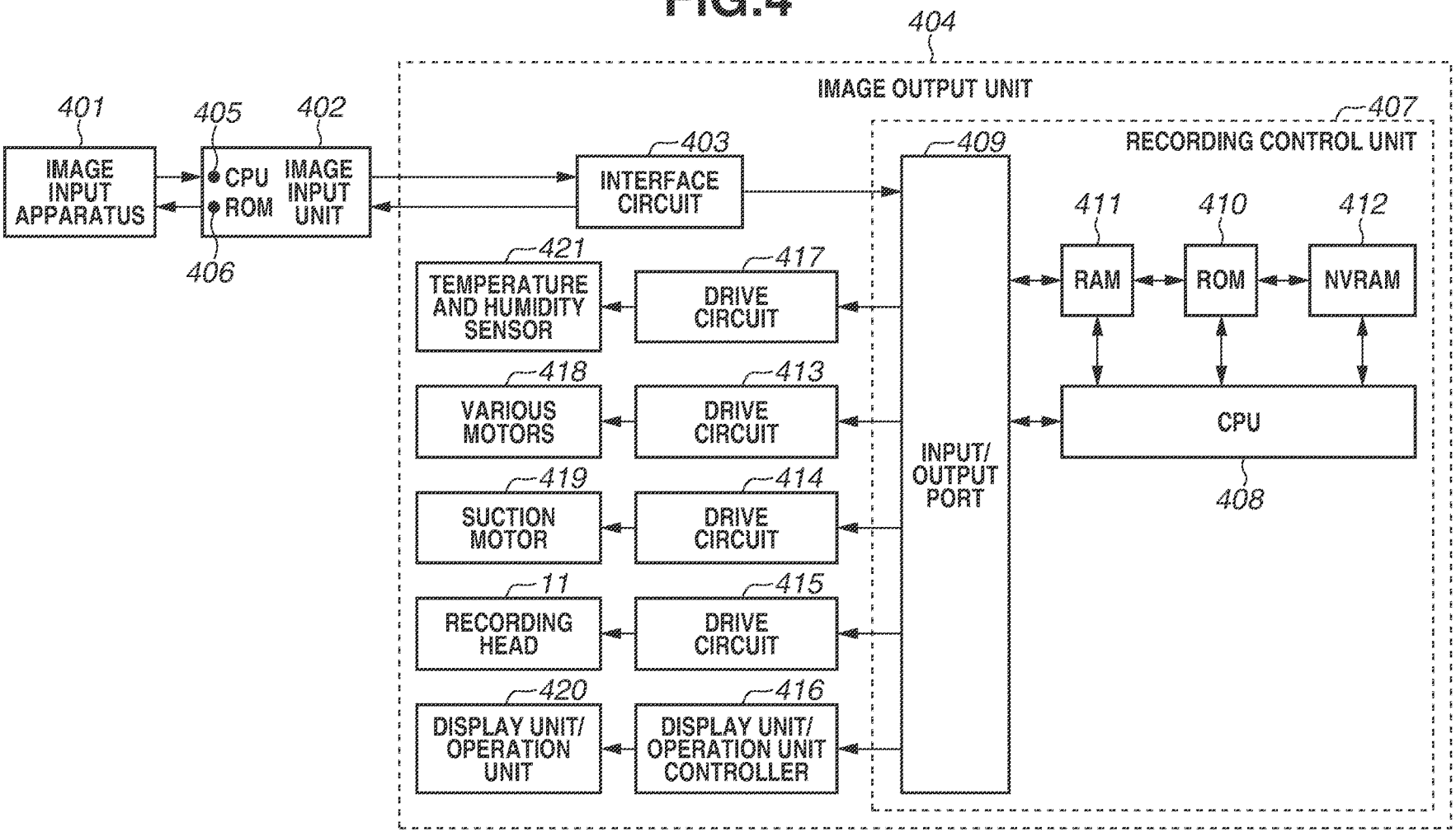
FIG. 4 is a block diagram illustrating a control configuration of the inkjet recording apparatus according to the first exemplary embodiment.

A control configuration for performing control of the recording apparatus 100 will be described next. FIG. 4 is a block diagram illustrating a configuration of a control system of the recording apparatus 100. First, multi-value image data stored in an image input apparatus 401 such as a scanner or a digital camera, or various types of storage media such as a hard disk, is input to an image input unit 402.

The image input unit 402 is a host computer connected to an outside of the recording apparatus 100, and transfers image information to be recorded to an image output unit 404, which is the recording apparatus 100, through an interface circuit 403. The image input unit 402 includes a central processing unit (CPU) 405 used for image data transfer, and a read only memory (ROM) 406 as a storage element. The host computer may be a computer serving as an information processing apparatus or may be provided as an image reader.

A recording control unit 407 includes therein a CPU 408, an input/output port 409, a ROM 410 that is a storage element for storing control programs, a random access memory (RAM) 411 that serves as a work area for performing various kinds of image processing, and a nonvolatile memory NVRAM 412. The ROM 410 stores the control programs for the CPU 408, and various kinds of data such as parameters for the recording operation. The RAM 411 is used as the work area of the CPU 408, and temporarily stores various kinds of data, such as image data received from the image input unit 402 and generated recording data. The recording apparatus 100 records an image by discharging ink from the discharge ports of the recording head 109 onto the recording medium 107, based on image data subjected to conversion by the recording control unit 407.

The recording control unit 407 is connected with a drive circuit 413 of various motors 418 for operating the carriage 101 and the conveyance roller pair 106, via the input/output port 409. The recording control unit 407 is also connected with a drive circuit 414 of a suction motor 419 for driving the suction pump 206 and a drive circuit 415 of the recording head 109, via the input/output port 409. The input/output port 409 is connected with a drive circuit 417 of sensors such as a temperature and humidity sensor 421 for detecting the temperature and humidity in a surrounding environment of the recording apparatus 100. The input/output port 409 is also connected with a display unit/operation unit controller 416 for controlling a display unit/operation unit 420 of the recording apparatus 100.

<Ink Composition>

As a coloring agent used for the ink for inkjet recording, a water-soluble dye is used from the viewpoint of a high level of image quality such as saturation and color reproducibility of the coloring material, a wide variety of available coloring materials, water solubility, and reliability such as resistance to clogging. However, because water-soluble dyes have issues with resistance to light and water, an increasing number of recording apparatuses use pigment ink that is more excellent in resistance to light and water than dyes. The recording apparatus 100 according to the present exemplary embodiment also use pigment ink.

Ink formulation according to the present exemplary embodiment will be described in detail next. The present disclosure is not limited to the following exemplary embodiments as long as the spirit and scope thereof are not exceeded. In the following descriptions, "parts" and "%" are on a mass basis unless otherwise specified.

<Preparation of Pigment Dispersion Liquid>

(a) Preparation of Black Pigment Dispersion Liquid

First of all, 20.0 parts pigment, 60.0 parts resin water solution, and 20.0 parts water are put in a bead mill (LMZ2 from Ashizawa Finetech) with an 80% filling factor of zirconia beads with a 0.3 mm diameter, and then dispersed at 1,800 revolutions per minute (rpm) for five hours. For the pigment, carbon black (Product Name: Printex90 from Degussa) is used.

For the resin water solution, a solution with a resin content (a solid content) of 20.0% is used. The resin water solution contains Joncryl®678 (from Johnson Polymer) that is a styrene acrylic copolymer and is neutralized with potassium hydroxide equivalent to the acid value. Subsequently, centrifugal separation is performed at 5,000 rpm for 30 minutes to remove agglomerated components. Furthermore, dilution with ion-exchange water is performed to obtain a black pigment dispersion liquid with a pigment content of 15.0% and a water-soluble resin (a dispersant) content of 9.0%.

(b) Preparation of Magenta Pigment Dispersion Liquid

The pigment is changed to C.I.Pigment Red 122 (Product Name: Toner Magenta E02 from Clariant). Otherwise, a magenta pigment dispersion liquid with a pigment content of 15.0% and a water-soluble resin (a dispersant) content of 9.0% is obtained using a similar procedure to that for the preparation of the black pigment dispersion liquid.

(c) Preparation of Cyan Pigment Dispersion Liquid

The pigment is changed to C.I.Pigment Blue 15:3 (Product Name: Toner Cyan BG from Clariant). Otherwise, a cyan pigment dispersion liquid with a pigment content of 15.0% and a water-soluble resin (a dispersant) content of 9.0% is obtained using a similar procedure to that for the preparation of the black pigment dispersion liquid.

(d) Preparation of Yellow Pigment Dispersion Liquid)

The pigment is changed to C.I.Pigment Yellow 74 (Product Name: Hansa Brilliant Yellow 5GX from Clariant). Otherwise, a yellow pigment dispersion liquid with a pigment content of 15.0% and a water-soluble resin (a dispersant) content of 9.0% is obtained using a similar procedure to that for the preparation of the black pigment dispersion liquid.

<Ink Adjustment>

After mixing of the components (unit: %) described in the upper rows of Table 1, pigment inks of four colors of cyan (C), magenta (M), yellow (Y), and black (BK) are prepared by subjecting the mixture to pressure filtration using a membrane filter (HDCII Filter from Pall Corporation) with a pore size of 1.2 μm. The usage of ion-exchange water is set so that the total content of the components becomes 100.0%. Acetylenol E100 is a surfactant from Kawaken Fine Chemicals. The bottom row of Table 1 indicates the pigment content (unit: %) in each pigment ink. The inks obtained in this way are packed in respective cartridges.

BYK333 is added as a silicon-based surfactant. By reducing the surface tension using the silicon-based surfactant, an effect of improving the wet expansion on the recording medium 107 can be obtained. A fluorine-based surfactant is also used to reduce the surface tension. However, these surfactants make the ink foam easily, as is the case where the surfactants are added to shampoo. Although a water-soluble resin is used to produce a dispersion, the defoaming property may decrease as the ink becomes sticky.

Because of the high foaming and low defoaming property, there may arise an issue of clogging of the air communication tube 204 with foam (described in detail below).

TABLE 1

Ink Compositions and Properties

| Ink name | BK | C | M | Y |
|---|---|---|---|---|
| Black pigment dispersion liquid | 30 | | | |
| Cyan pigment dispersion liquid | | 30 | | |
| Magenta pigment dispersion liquid | | | 30 | |
| Yellow pigment dispersion liquid | | | | 30 |
| Glycerin | 10 | 10 | 10 | 10 |
| Ethyleneglycol | 10 | 10 | 10 | 10 |
| Acetylenol E100 | 1 | 1 | 1 | 1 |
| BYK333 | 5 | 5 | 5 | 5 |
| Ion-exchange water | 44 | 44 | 44 | 44 |
| Pigment density | 4.5 | 4.5 | 4.5 | 4.5 |

<Recovery of Recording Head>

In a case where the recording apparatus 100 does not use the recording head 109 for the recording operation, the discharge port surface is capped by the cap 202 to prevent moisture evaporation from the discharge ports. However, even in a state where the discharge port surface is capped by the cap 202, leaving the recording head 109 for a prolonged period of time promotes moisture evaporation from the discharge ports to increase the ink viscosity, which makes it difficult to discharge ink properly. For this reason, in a case where the recording head 109 starts the recording operation in the capped state, the recording head 109 performs a preliminary discharge operation for preliminarily discharging ink, based on how long the recording head 109 has been left in the capped state, thereby discharging thickened ink due to the evaporation from the discharge ports. Alternatively, it is common to restore the discharge state of the recording head 109 by performing suction recovery (described below) using the suction pump 206.

Figure 5:
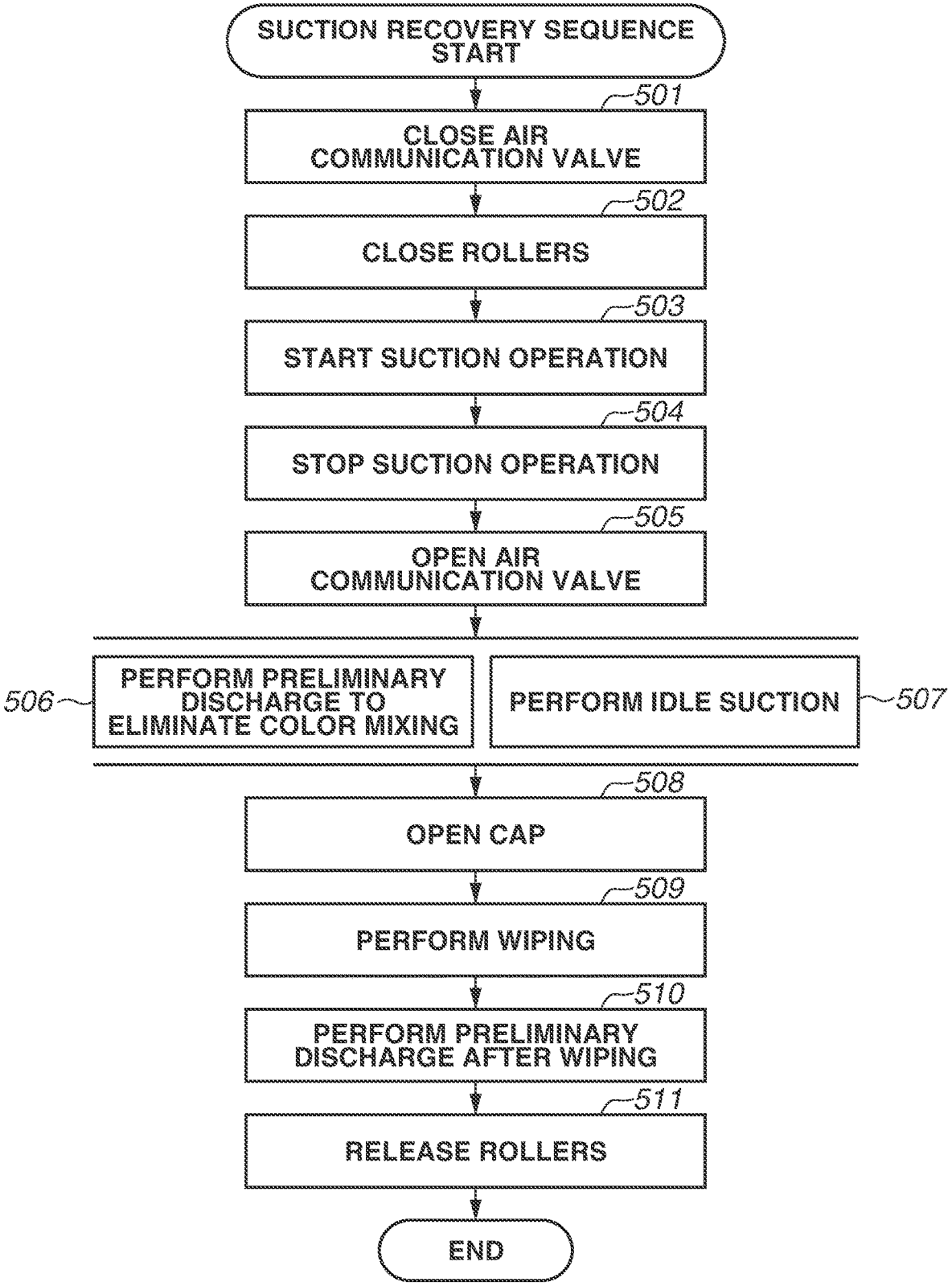
FIG. 5 is a flowchart illustrating a conventional suction recovery sequence.

A conventional suction recovery sequence performed by the recovery device 108 will be described next with reference to FIG. 5. The suction recovery sequence illustrated in FIG. 5 is started in a state where the discharge port surface of the recording head 109 is capped by the cap 202. The cap 202 at the capping position is pressed against the discharge port surface by a pressing unit (not illustrated) including a spring and configured to set the contact pressure on the discharge port surface to a predetermined value.

In step 501, the CPU 408 closes the air communication valve 205. In step 502, the CPU 408 closes the rollers 209. In step 503, the CPU 408 drives the suction pump 206 to start a suction operation for sucking ink from the discharge ports of the recording head 109. The operation to close the rollers 209 in step 502 refers to moving the rollers 209 to positions where the rollers 209 press the suction tube 203.

After the suction operation has been continued for a predetermined time, then in step 504, the CPU 408 stops the suction operation. In step 505, the CPU 408 opens the air communication valve 205 to communicate the inside of the cap 202 with the atmosphere. The inside of the cap 202 depressurized in the suction operation is opened to the atmosphere in step 505. Then, in step 507, the CPU 408 drives the suction pump 206 again to suck and discharge the ink accumulated inside the cap 202. Sucking ink from the cap 202 in a state where the inside of the cap 202 is opened to the atmosphere is referred to as idle suction.

In the present exemplary embodiment, since the cap 202 is configured to collectively cap the plurality of discharge port arrays 110, the plurality of color inks discharged in the suction operation in step 503 may be mixed in the cap 202. Due to the cap 202 being filled with this mixed color ink, the mixed color ink may enter into the discharge ports. In particular, a negative pressure due to the water head difference of the ink is set to be applied to the discharge ports in order to prevent ink leakage from the discharge ports. Thus, the mixed color ink that enters into the discharge ports may flow back to an inside of the recording head 109 or the ink tank 213.

Meanwhile, after the suction operation is stopped, the processing immediately proceeds to step 506. In step 506, the CPU 408 causes the recording head 109 to perform the preliminary discharge operation for eliminating color mixing. In the present exemplary embodiment, the CPU 408 performs the preliminary discharge operation in parallel with the idle suction in step 507. Immediately performing the preliminary discharge operation enables prevention of the mixed color ink from scattering inside the recording head 109 with the passage of time, thereby also reducing the amount of ink for the preliminarily discharge operation.

In step 508, the CPU 408 moves the cap 202 to the separated position. In step 509, the CPU 408 causes the wiper 211 to wipe the discharge port surface to remove ink adhering to the discharge port surface. In step 510, the CPU 408 performs the preliminary discharge operation again (performs preliminary discharge after wiping) to remove the mixed color ink pushed into the discharge ports by the wiper 211 during the wiping. This completes the suction recovery sequence. In step 511, the CPU 408 performs a roller release operation by moving the rollers 209 to the positions where the rollers 209 do not press the suction tube 203. The roller release operation may be performed at any timing after completion of the idle suction in step 507.

When performing the idle suction in step 507, the CPU 408 sets the amount of ink to be discharged in the preliminary discharge operation and the discharge speed of the suction pump 206 in order to prevent the cap 202 from being filled with the ink discharged in the preliminary discharge operation in step 506 that is performed in parallel with step 507. In the present exemplary embodiment, the configuration where the preliminary discharge operation for eliminating color mixing and the idle suction are performed at the same time has been described. Alternatively, a configuration where the idle suction is started before the preliminary discharge operation may be used.

In general, the above-described suction recovery sequence can appropriately maintain the discharge state of the recording head 109. However, in the case of using the above-described ink that is easy to foam and difficult to defoam, there may occur a phenomenon where the ink discharge amount increases due to the air communication tube 204 being clogged with foam during the suction recovery sequence. More specifically, while the CPU 408 performs the idle suction in step 507 during the suction recovery sequence, there may occur a phenomenon (hereinafter referred to as oversuction) where ink is sucked from not only the inside of the cap 202 but also the ink tank 213.

In the present exemplary embodiment, as described above, the CPU 408 manages the remaining ink amount of the ink tank 213 by using the dot counter to count the ink amount discharged from the discharge port arrays 110. However, if oversuction occurs, a larger amount of ink than the discharged ink amount managed by the dot counter is discharged. More specifically, the remaining ink amount of the ink tank 213 becomes less than the ink amount managed by the dot counter. Consequently, continuing the recording operation with the insufficient ink amount results in degradation of print quality, such as white streaks or while spots.

Figure 6A:
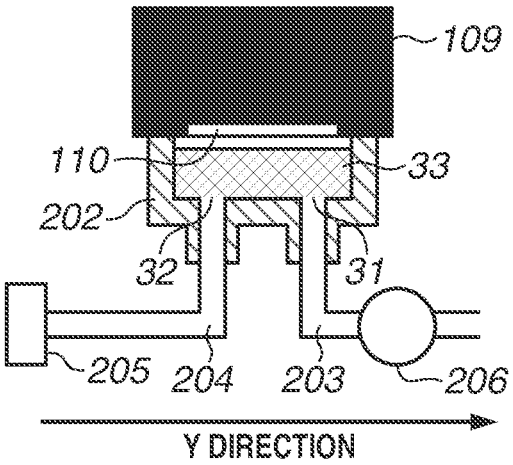
FIGS. 6A to 6E are schematic cross-sectional views each illustrating the recovery device during the suction recovery sequence.

An occurrence mechanism of the oversuction according to the present exemplary embodiment will be described next with reference to FIGS. 6A to 6E. FIGS. 6A to 6E are schematic cross-sectional views each illustrating the recovery device 108 and an area near the recovery device 108 during the suction recovery sequence. FIG. 6A illustrates a state immediately after the start of the suction operation in step 503 in FIG. 5. This is the state immediately after the start of the rotation of the suction pump 206 with the air communication valve 205 closed, and thus no ink is sucked from the discharge port arrays 110.

Figure 6B:
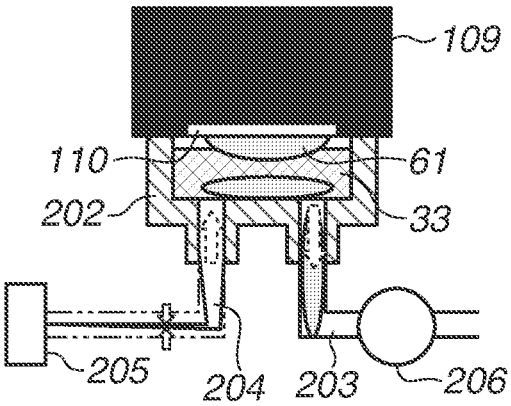

FIG. 6B illustrates a state where discharge of air from the cap 202 progresses, and ink 61 is sucked from the discharge port arrays 110. The ink 61 passes through the absorber 33 and then flows into the suction tube 203. Arrows drawn with broken lines represent an air flow. The driving of the suction pump 206 causes air to be sucked (discharged) not only from the inside of the cap 202 but also from the air communication tube 204. Accordingly, the air communication tube 204 from which air is sucked is squeezed.

Figure 6C:
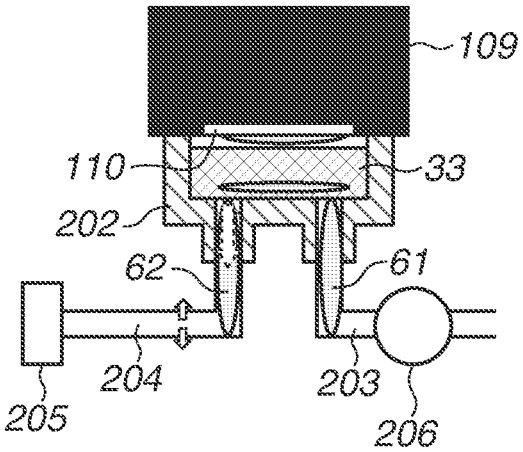

FIG. 6C illustrates a state immediately after the suction pump 206 is deactivated to stop the suction operation in step 504. Since the negative pressure in the cap 202 is relaxed, the air communication tube 204 that has been squeezed is restored in shape. When the air communication tube 204 is restored in shape, an air flow occurs in a direction indicated by an arrow drawn with broken lines. Accordingly, there occurs a phenomenon where ink 62 flows back from the cap 202 to the air communication tube 204.

Figure 6D:
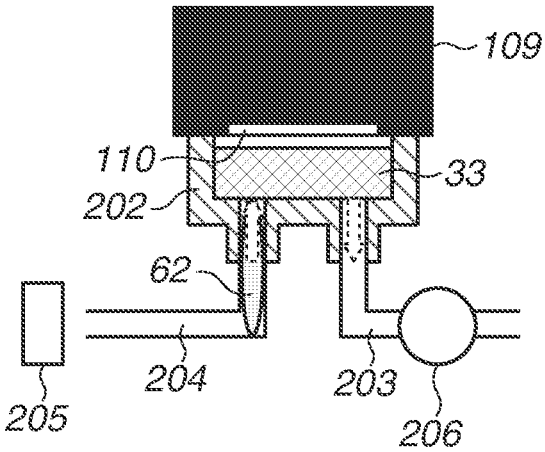

FIG. 6D illustrates a state immediately after the start of the idle suction in step 507. The air communication valve 205 is opened to perform the idle suction. In the case of using ink difficult to foam, such as dye ink, the ink 62 that flows back to the air communication tube 204 is also sucked and discharged by the suction pump 206 during the idle suction. While the ink is being sucked from the air communication tube 204 in the idle suction, no ink is sucked from the discharge port arrays 110.

Figure 6E:
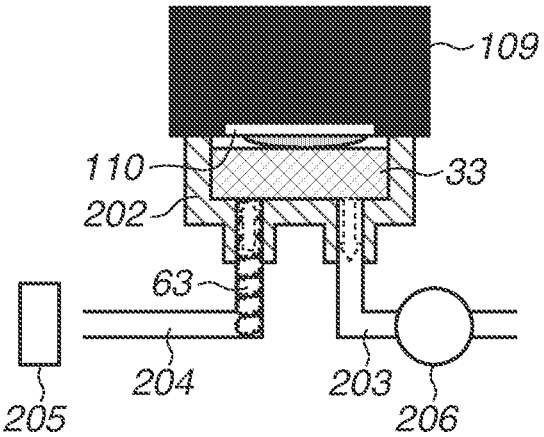

On the other hand, in the case of using ink easy to foam and difficult to defoam, even if the CPU 408 opens the air communication valve 205 to perform the idle suction, oversuction occurs, i.e., the ink is sucked from the discharge port arrays 110 due to occurrence of foam in the air communication tube 204. FIG. 6E illustrates the recovery device 108 at the same timing as that in FIG. 6D, but a state where the ink that is easy to foam and difficult to defoam flows back to the air communication tube 204.

As illustrated in FIG. 6E, in a case where foam 63 exists in the air communication tube 204, a large pressure loss occurs compared with a case where nothing other than a liquid exists in the air communication tube 204. More specifically, because the pressure for sucking the foam 63 is higher than the meniscus tolerance pressure in the discharge port arrays 110, the meniscus in the discharge ports is broken by the suction of the suction pump 206, and the ink is discharged from the discharge port arrays 110.

The present exemplary embodiment is directed to solving the above-described issue. Applying an oversuction countermeasure sequence instead of the suction recovery sequence enables reduction of the ink amount discharged in the idle suction, without an additional special mechanism.

Figure 7:
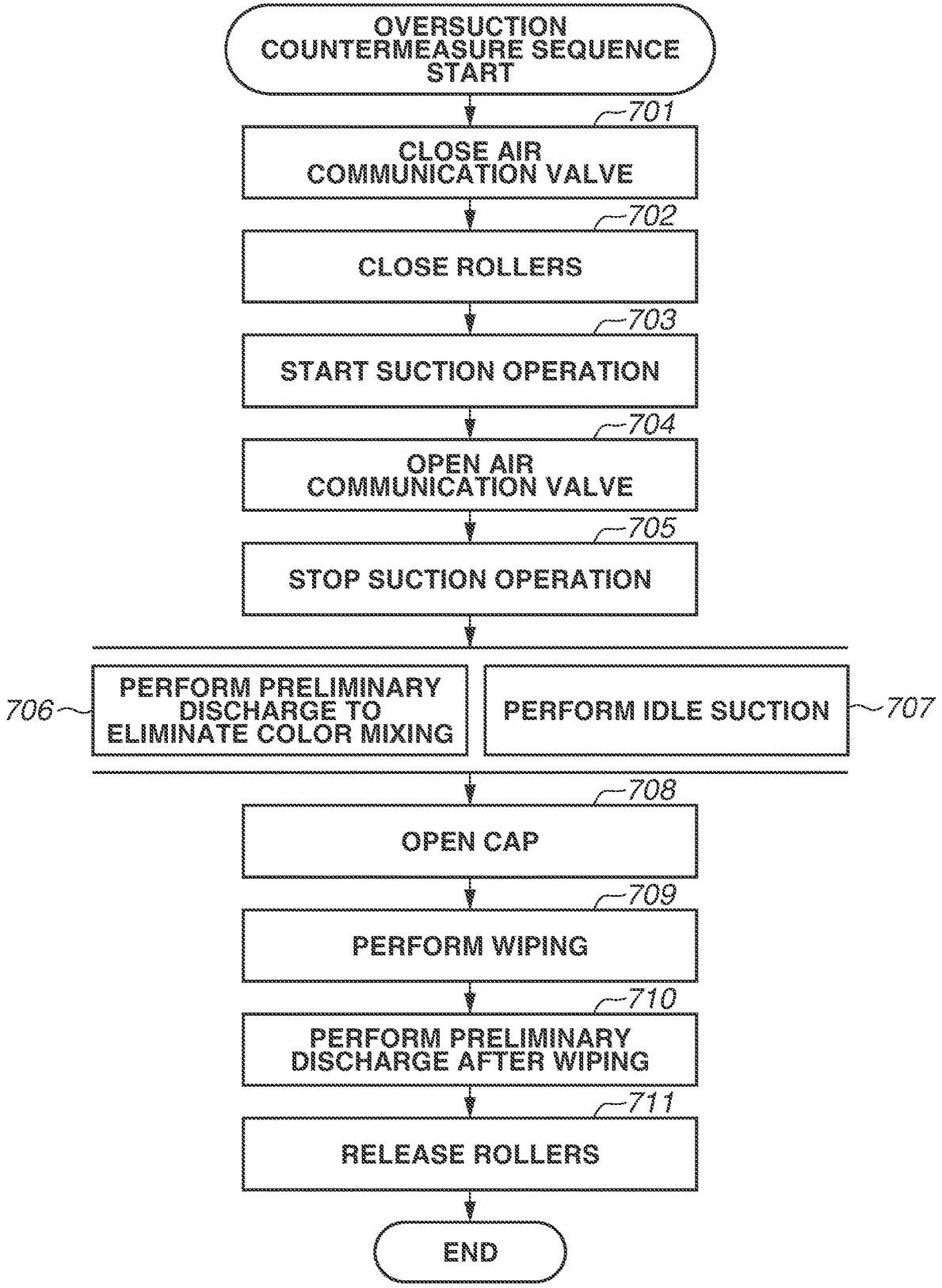
FIG. 7 is a flowchart illustrating an oversuction countermeasure sequence according to the first exemplary embodiment.

The oversuction countermeasure sequence will be described next with reference to FIG. 7. The basic operation is the same as the suction recovery sequence described above with reference to FIG. 5. Steps 701 to 703 correspond to steps 501 to 503, respectively, and steps 706 to 711 correspond to steps 506 to 511, respectively. In the oversuction countermeasure sequence, after the CPU 408 starts the suction operation in step 703, the CPU 408 opens the air communication valve 205 in step 704, and then stops the suction pump 206 in step 705. More specifically, the oversuction countermeasure sequence is different from the conventional suction recovery sequence in that the air communication valve 205 is opened before the suction operation is stopped.

Figure 8:
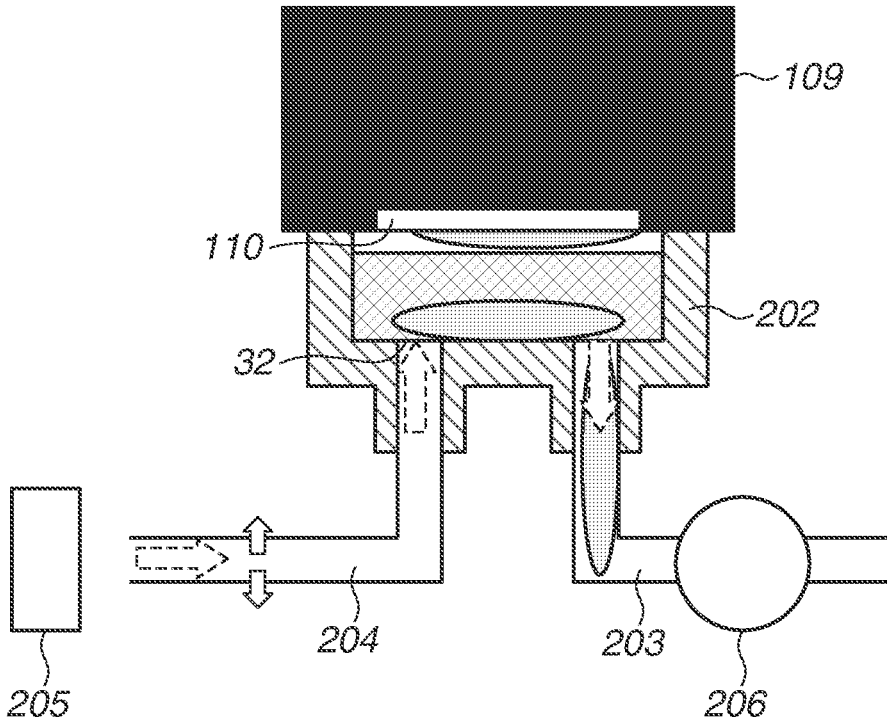
FIG. 8 is a schematic cross-sectional view of the recovery device and an area near the recovery device, which illustrates an effect of the oversuction countermeasure sequence according to the first exemplary embodiment.

FIG. 8 is a schematic cross-sectional view of the recovery device 108 and the area near the recovery device 108, which illustrates an effect of the oversuction countermeasure sequence. In the oversuction countermeasure sequence, the CPU 408 opens the air communication valve 205 in a state where the suction operation of the suction pump 206 has been continued. Thus, in the air communication tube 204, air flows from the air communication valve 205 toward the air communication port 32, as indicated by arrows drawn with broken lines. Although the air communication tube 204 squeezed in step 703 (see FIG. 6B) is restored when the CPU 408 opens the air communication valve 205, the air flow in the direction indicated by the arrows drawn with broken lines prevents ink backflow from the cap 202 to the air communication tube 204. This also prevents the occurrence of the foam 63 illustrated in FIG. 6E.

FIG. 9 is a table illustrating a comparison between the suction amount of the black ink sucked from the discharge port array 110K in the suction operation and the oversuction amount of the black ink sucked from the discharge port array 110K in the idle suction. FIG. 9 illustrates comparison results among the present exemplary embodiment, a first comparative example, and a second comparative example, which are obtained by using the black ink as an example of the ink that is easy to foam and difficult to defoam. Referring to FIG. 9, the suction time refers to a period from start to end of the driving of the suction pump 206, and corresponds to a total time of the suction operation and the idle suction. The suction amount is obtained by measuring a weight change of the ink tank 213 before and after the suction operation. The oversuction amount is obtained by measuring a weight change of the ink tank 213 before and after the idle suction.

The row titled "First Comparative Example" indicates the suction time, the suction amount, and the oversuction amount in a case where the suction operation and the idle suction are performed in the normal suction recovery sequence in the first comparative example. In the first comparative example, the total suction time is set to 2.0 seconds, the suction amount in the suction operation is 260 mg, and the measured oversuction amount in the idle suction is 30 mg.

The row titled "Second Comparative Example" indicates the suction time, the suction amount, and the oversuction amount in a case where the suction operation is performed but the idle suction is not performed in the normal suction recovery sequence in the second comparative example. The suction time of the suction operation is 2.0 seconds, and the suction amount thereof is 230 mg. In the second comparative example, since the idle suction is not performed, the oversuction amount is not a measurement target.

The row titled "First Exemplary Embodiment" indicates the suction time, the suction amount, and the oversuction amount in a case where the suction operation and the idle suction are performed in the oversuction countermeasure sequence according to the present exemplary embodiment. Performing the oversuction countermeasure sequence according to the present exemplary embodiment successfully reduces the oversuction amount in the idle suction to 0 mg. In the present exemplary embodiment, the suction time is set to 2.2 seconds so as to suck the suction amount (230 mg) for allowing a sufficient recovery operation for the recording head 109. The reason is that, when the air communication valve 205 is opened during operation of the suction pump 206, the negative pressure returns to the atmospheric pressure in a shorter time than when the air communication valve 205 is opened after completion of the operation, and the ink amount that can be sucked becomes lower in the same suction time.

In this way, opening the air communication valve 205 during the operation of the suction pump 206 can prevent oversuction, i.e., ink suction from the discharge port arrays 110 in the idle suction.

This makes it possible to appropriately manage the remaining ink amount in the ink tank 213 using the dot counter.

While in the present exemplary embodiment, the configuration where the discharge port arrays 110 for the plurality of ink colors are capped by the cap 202 for suction has been described, the oversuction countermeasure sequence is also applicable to a configuration where the discharge port array 110 for one ink color is capped by one cap 202. In the case of suction for one ink color, the preliminary discharge operation for eliminating color mixing in step 706 can be omitted.

In the above-described first exemplary embodiment, the oversuction countermeasure sequence that is performed when the discharge port arrays 110 for the plurality of ink colors are collectively sucked has been described. A second exemplary embodiment is directed to performing the oversuction countermeasure when suction is performed using a plurality of the caps 202. More specifically, in the second exemplary embodiment, a two cap configuration where the cyan ink and the magenta ink are collectively sucked by using one cap (hereinafter referred to as the left cap), and the yellow ink and the black inks are collectively sucked by using the other cap (hereinafter referred to as the right cap) will be applied.

Similarly to the first exemplary embodiment, the suction tube 203, the air communication tube 204, the air communication valve 205, and the rollers 209 are prepared for each of the left and right caps. The rollers 209 are configured to open or close the left and right caps at a time. Thus, when performing the suction operation using one of the caps, the CPU 408 drives the suction pump 206 in a state where the air communication valve 205 connected with the cap used in the suction operation is closed, and the air communication valve 205 connected with the cap not used in the suction operation is opened.

Figure 10:
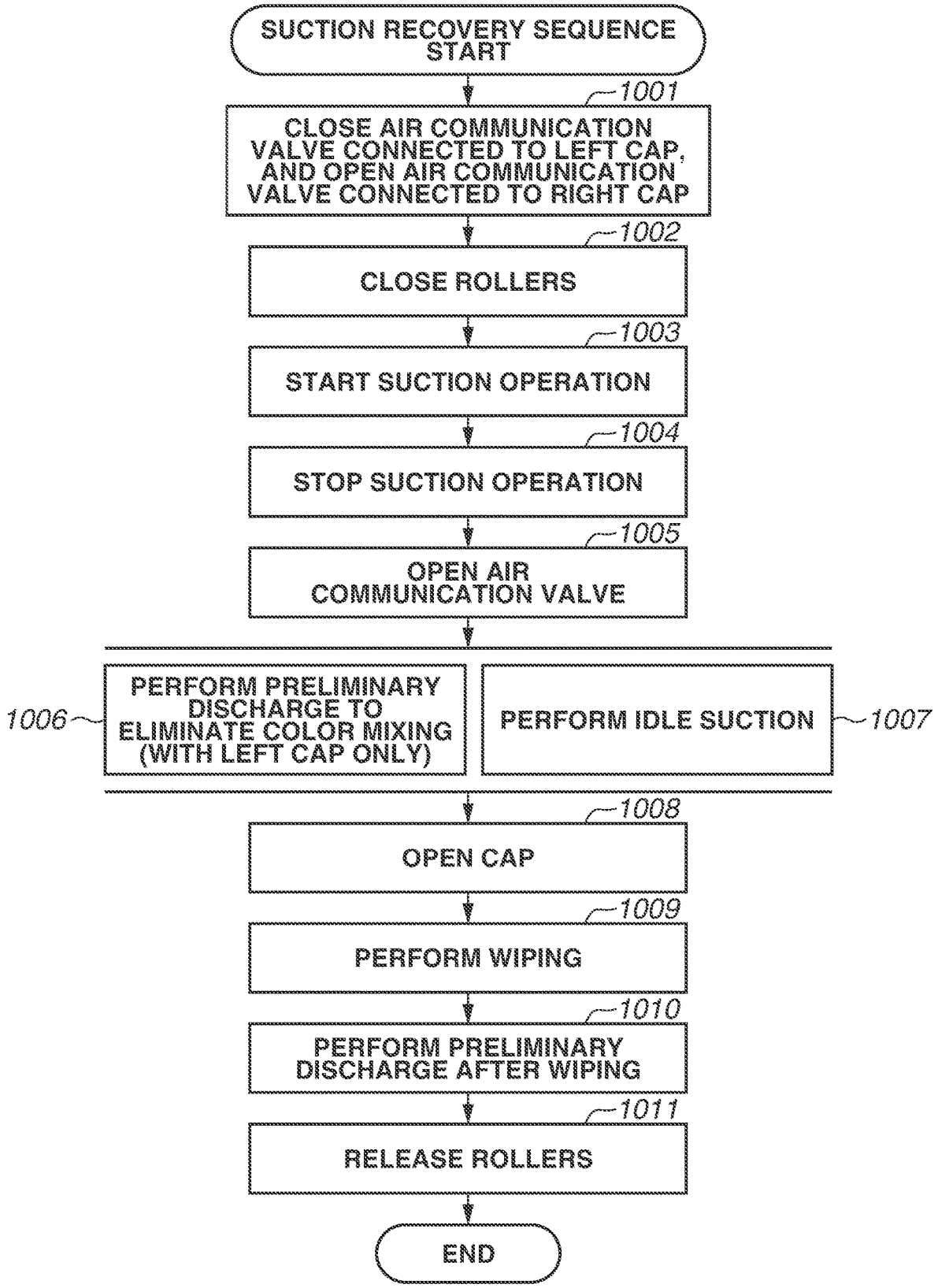
FIG. 10 is a flowchart illustrating a conventional suction recovery sequence performed in a two cap configuration according to a second exemplary embodiment.

A case where the normal suction recovery sequence is performed using the left cap (without using the right cap) will be described next with reference to FIG. 10. In step 1001, the CPU 408 closes the air communication valve 205 connected with the left cap, and opens the air communication valve 205 connected with the right cap. Steps 1002 to 1004 correspond to steps 502 to 504, respectively. In the suction operation in step 1003, the discharge port arrays 110 capped by the left cap are subjected to ink suction, whereas the discharge port arrays 110 capped by the right cap are subjected not to the ink suction but to the idle suction.

In step 1005, the CPU 408 opens the closed left cap. In step 1006, the CPU 408 performs the preliminary discharge operation for eliminating mixing of the cyan ink and the magenta ink from the discharge port arrays 110 capped by the left cap. In step 1007, in parallel with the preliminary discharge operation, the CPU 408 performs the idle suction for both the right and left caps. During the idle suction, ink and foam that flow back to the air communication tube 204 for the left cap may cause oversuction, i.e., cause inks to be sucked and discharged from the discharge port arrays 110 capped by the left cap.

Figure 11:
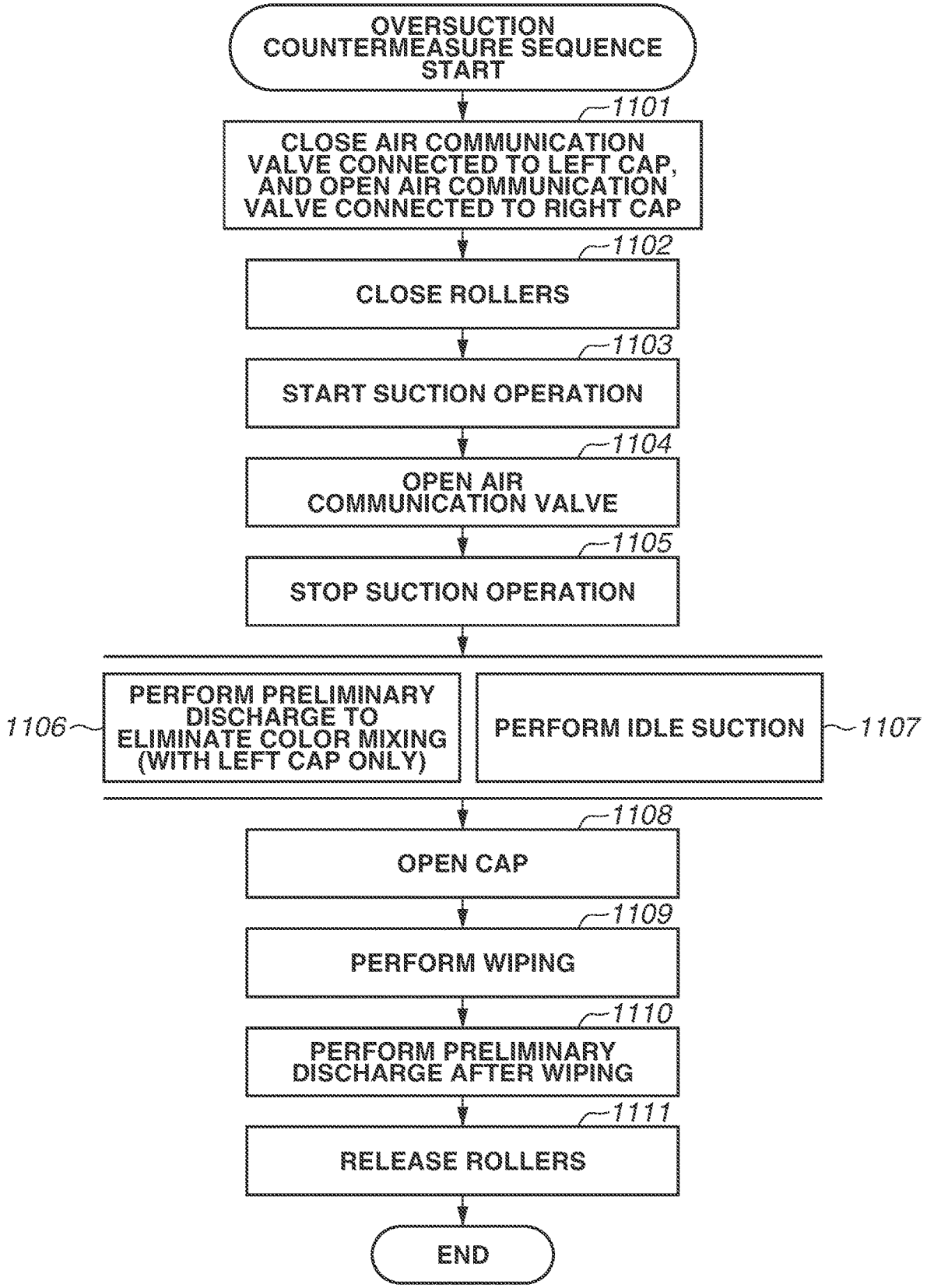
FIG. 11 is a flowchart illustrating an oversuction countermeasure sequence according to the second exemplary embodiment.

FIG. 11 illustrates an oversuction countermeasure sequence according to the present exemplary embodiment that is performed when the suction operation is performed using one of the caps 202. In step S1001, the CPU 408 selects the opening or closing of the air communication valve 205 to control whether to perform the suction recovery sequence using one of the caps 202 or both of the caps 202.

FIG. 11 illustrates the oversuction countermeasure sequence according to the present exemplary embodiment that is performed when the suction recovery sequence is performed using one of the caps 202. The basic operation is the same as the suction recovery sequence described above with reference to FIG. 10. Steps 1101 to 1103 correspond to steps 1001 to 1003, respectively, and steps 1106 to 1111 correspond to steps 1006 to 1011, respectively. In the oversuction countermeasure sequence illustrated in FIG. 11, in step 1104, the CPU 408 opens the air communication valve 205 connected with the left cap in a state where the suction operation has been continued. Then in step 1105, the CPU 408 stops the suction pump 206.

Also in the configuration where the common suction pump 206 is used for the plurality of the caps 202 as in the present exemplary embodiment, opening the air communication valve 205 before stopping the suction operation can provide a similar effect to that of the first exemplary embodiment.

Figure 12A:
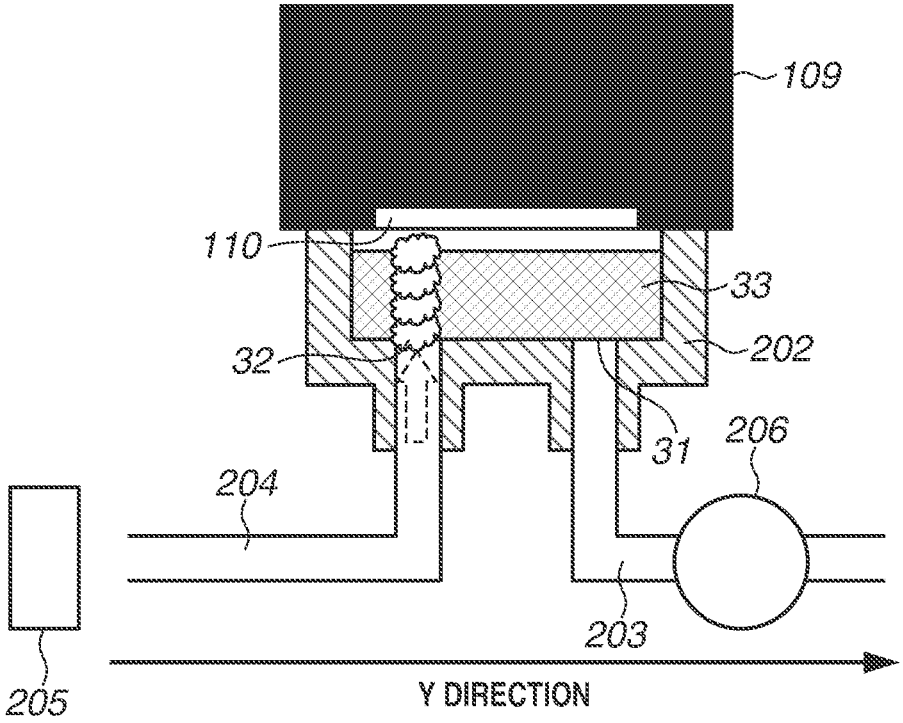
FIG. 12A is a schematic cross-sectional view illustrating the recovery device during the oversuction countermeasure sequence.

A third exemplary embodiment will be described next. In a case where the air communication valve 205 is opened during the operation of the suction pump 206 in the oversuction countermeasure sequence according to the first and the second exemplary embodiments, air flows from the air communication valve 205 toward the air communication port 32 as described above. At this time, as illustrated in FIG. 12A, the ink and foam held by the absorber 33 of the cap 202 may be raised by the air that enters into the cap 202 from the air communication port 32, and may come into contact with the discharge port arrays 110.

Figure 12B:
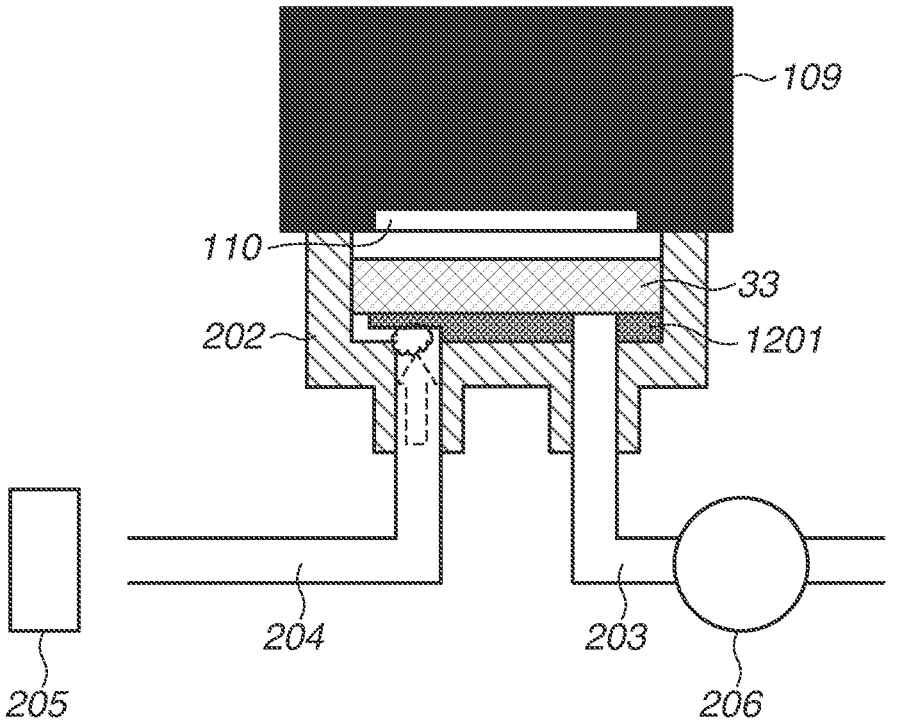
FIG. 12B is a schematic cross-sectional view illustrating a recovery device according to a third exemplary embodiment during the oversuction countermeasure sequence.

If the ink (or foam) comes into contact with the discharge port arrays 110 and enters into the discharge ports, the recovery operation may not be performed sufficiently with the preliminary discharge operation. To address this issue, in the present exemplary embodiment, a configuration for preventing the backflow ink from the air communication port 32 from hitting the discharge port arrays 110 when the oversuction countermeasure sequence is performed is applied. More specifically, as illustrated in FIG. 12B, a plate-like member 1201 is provided in the cap 202, as a partition member between the air communication port 32 and the discharge port arrays 110.

Figure 13A:
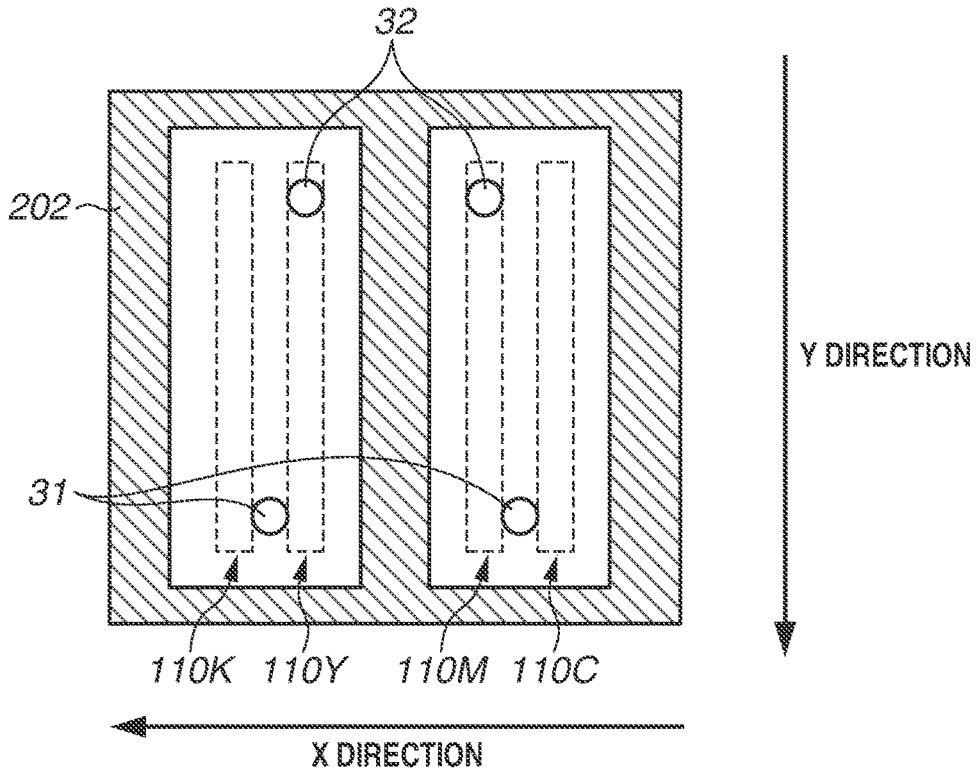
FIGS. 13A and 13B are top views each illustrating a cap configuration according to the third exemplary embodiment.
Figure 13B:
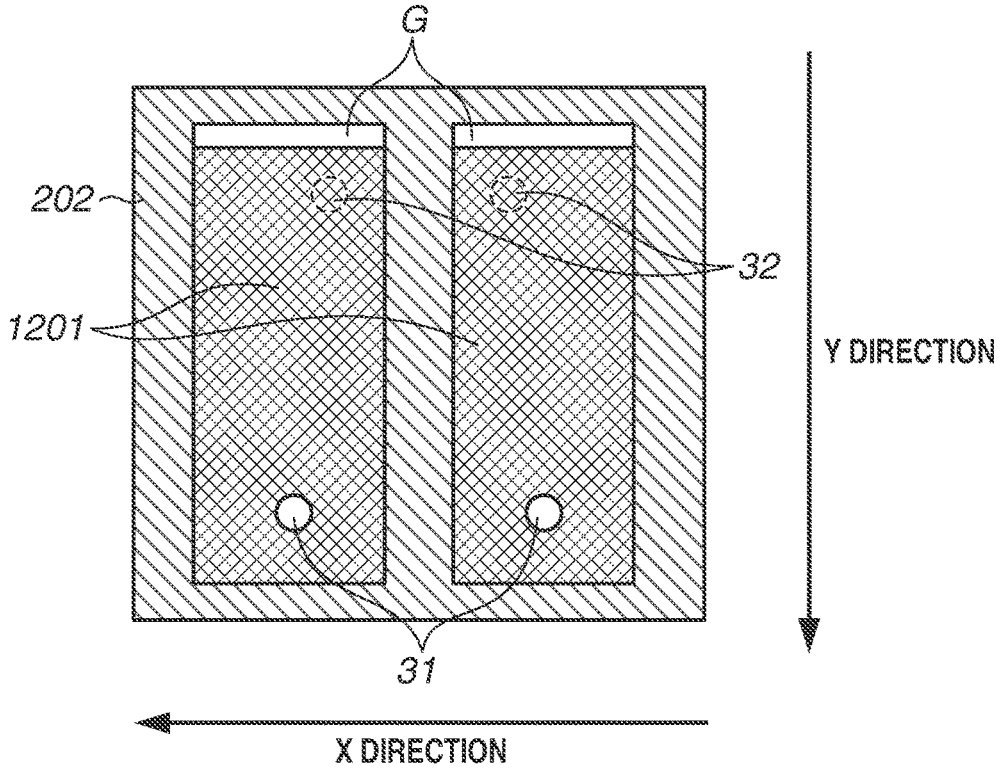

FIGS. 13A and 13B illustrate in detail a positional relationship between the air communication ports 32 and the discharge port arrays 110 when the cap 202 is viewed from above. FIG. 13A is a top view of the cap 202 in which the absorber 33 and the plate-like member 1201 are not illustrated, and FIG. 13B is a top view of the cap 202 in which the absorber 33 is not illustrated and the plate-like member 1201 is illustrated.

As illustrated in FIG. 13A, the air communication ports 32 are provided immediately below the discharge port arrays 110Y and 110M. Thus, as illustrated in FIG. 13B, the plate-like member 1201 is disposed below the absorber 33, at a position where the plate-like member 1201 covers the air communication ports 32. In order not to reduce the suction efficiency of the suction pump 206, the suction ports 31 are not covered by the plate-like member 1201. The plate-like member 1201 is disposed apart from the cap 202 by a gap G on the upstream side in the Y direction so as not to disturb the air flow generated by the suction pump 206.

As described above, employing the configuration according to the present exemplary embodiment in addition to the configurations according to the first and the second exemplary embodiments enables further reduction of ink color mixing in the discharge port arrays 110.

In the above-described exemplary embodiments, the configuration where the ink tank 213 is mounted on the carriage 101 has been described. However, the exemplary embodiments of the present disclosure are also applicable to a configuration where the recording head 109 and the ink tank 213 are supplied with a tube in a configuration where the ink tank 213 is fixed to or detachably attached to the recovery device 108.

In addition, the exemplary embodiments are not limited to the above-described suction operation. For example, in a configuration where the ink is supplied to the recording head 109 via a tube, a sequence of activating the suction pump 206 in a state where the valve for closing the tube is closed, and then opening the valve to perform the suction operation can be applied.

In the above-described exemplary embodiments, the recording head 109 using the serial recording method that records an image while repeating the intermittent conveyance operation and the recording operation has been described. However, the exemplary embodiments of the present disclosure are also applicable to a recording head using the full-line method and having a plurality of discharge ports in a region corresponding to a width of the recording medium 107.

The exemplary embodiments of the present disclosure are also applicable to all types of the recording apparatuses 100 using paper, cloths, nonwoven fabrics, overhead projector (OHP) films, and other recording media, and the recording medium to be used is not specifically limited. Specific apparatuses to which the exemplary embodiments are applicable include business machines such as printers, copying machines, and facsimiles, and machines for industrial applications such as mass production machines and semiconductor elements.

In the above-described exemplary embodiments, the configuration where the recording control unit 407 that performs characteristic processing according to the exemplary embodiments is included in the recording apparatus 100 has been described. However, the recording control unit 407 may not necessarily be included in the recording apparatus 100. For example, a printer driver of the host computer (the image input unit 402) connected with the recording apparatus 100 may be provided with the function of the recording control unit 407. A recording system including such a host computer and the recording apparatus 100 is also included in the exemplary embodiments. In this case, the host computer functions as not only a data supply apparatus that supplies data to the recording apparatus 100 but also a control apparatus that controls the recording apparatus 100.

While the present disclosure includes exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-181988, filed Oct. 30, 2020, which is hereby incorporated by reference herein in its entirety.

What is claimed is:

1. A recording apparatus comprising:

a recording head having discharge ports for discharging a liquid;

a cap configured to be moved to a cap position for capping the discharge ports and to an uncap position for uncapping the discharge ports;

a valve configured to be switched between a communication state where an inside of the cap communicates with the atmosphere and a non-communication state where the inside of the cap does not communicate with the atmosphere; and a pump configured to depressurize the inside of the cap, wherein, after driving of the pump is started in a state where the cap is at the cap position and the valve is in the non-communication state, the valve is switched to the communication state and then the driving of the pump is stopped, and wherein, after stopping the driving of the pump, the pump is driven again in a state where the cap is at the position and the valve is in the communication state.

2. The recording apparatus according to claim 1, wherein, after the driving of the pump again, the cap is moved to the uncap position.

3. The recording apparatus according to claim 1, wherein the recording head includes first discharge ports and second discharge ports, wherein the cap includes a first cap configured to cap the first discharge ports and a second cap configured to cap the second discharge ports, and wherein the valve is selectively switchable between the first cap and the second cap.

4. The recording apparatus according to claim 1, further comprising an air communication tube configured to communicate the inside of the cap with the atmosphere, wherein the valve is configured to open and close the air communication tube.

5. The recording apparatus according to claim 4, wherein the cap includes an air communication port connected with the air communication tube, and a partition member that partitions the air communication port and the discharge ports.

6. The recording apparatus according to claim 1, wherein the pump depressurizes the inside of the cap via a tube connected to the cap.

7. The recording apparatus according to claim 1, wherein the valve and the pump are driven by different driving sources.

8. The recording apparatus according to claim 1, wherein the liquid is ink containing a water-soluble resin, or a fluorine- or silicon-based surfactant.

9. A method for controlling a recording apparatus including a recording head having discharge ports for discharging a liquid, a cap configured to be moved to a cap position for capping the discharge ports and to an uncap position for uncapping the discharge ports, and a pump configured to depressurize an inside of the cap, the method comprising:

starting driving of the pump in a state where the cap is at the cap position and the valve is in a non-communication state where the inside of the cap does not communicate with the atmosphere;

switching the valve to a communication state where the inside of the cap communicates with the atmosphere after the starting;

stopping the driving of the pump after the switching; and driving the pump in a state where the cap is at the position and the valve is in the communication state after the stopping.

10. The method according to claim 9, further comprising moving the cap to the uncap position after the driving.

* * * * *